US006151742A

United States Patent [19]

Dausch et al.

[11] Patent Number: 6,151,742

[45] Date of Patent: Nov. 28, 2000

[54] SYSTEM AND METHOD FOR PROVIDING FLOW RATE COMPENSATION IN A WASHING MACHINE

[75] Inventors: Mark Edward Dausch, Cohoes; Seth Alexander Capello, Saratoga, both of N.Y.

[73] Assignee: General Electric Company, Schenectady, N.Y.

[21] Appl. No.: 09/268,358

[22] Filed: Mar. 15, 1999

[51] Int. Cl.[7] ..... D06F 33/02

[52] U.S. Cl. ..... 8/158; 8/159; 68/12.02; 68/12.05

[58] Field of Search ..... 8/158, 159; 68/12.02, 68/12.04, 12.05

[56] References Cited

U.S. PATENT DOCUMENTS

| | | | |
|---|---|---|---|
| 4,480,449 | 11/1984 | Getz et al. | 68/12.02 |
| 5,235,827 | 8/1993 | Kiuchi et al. | 68/12.04 |
| 5,275,025 | 1/1994 | Nakamura et al. | 68/12.04 |
| 5,669,095 | 9/1997 | Dausch et al. | 8/158 |

*Primary Examiner*—Philip R. Coe

*Attorney, Agent, or Firm*—David C. Goldman; Jill M. Breedlove

[57] ABSTRACT

A system and method for providing flow rate compensation in a washing machine. This invention provides flow rate compensation by monitoring the flow rate of the inlet liquid and the agitator load while agitating. A controller uses a flow rate compensation algorithm to compensate for the varying flow rate of the inlet liquid and an adaptive fill algorithm to determine an optimal level of liquid to be added to the washer basket and washer tub during a wash cycle operation.

58 Claims, 9 Drawing Sheets

SYSTEM AND METHOD FOR PROVIDING FLOW RATE COMPENSATION IN A WASHING MACHINE

FIELD OF THE INVENTION

This invention relates generally to a washing machine for cleansing clothes and similar articles and more particularly to a washing machine that determines an optimal level of liquid added in a wash cycle operation by compensating for varying inlet liquid flow rates.

BACKGROUND OF THE INVENTION

Typically, during a normal operation of a washing machine, a user loads articles into a washer basket for cleansing, selects a wash cycle, and starts the machine. The washing machine then performs a number of operations to complete the wash cycle. Generally, the wash cycle includes a wash operation, a rinse operation and a spin operation. The wash operation includes filling the washer basket and a washer tub which contains the basket with a liquid such as water to a user selected level. An agitator disposed in the washer basket then imparts an oscillatory motion to the water and detergent (both the water and the detergent comprise the wash liquid) and the articles. The oscillatory motion causes the articles and wash liquid to move back and forth in the washer basket. This movement provides mechanical energy which assists in removing soils from the articles. After agitating the articles and wash liquid for a predetermined length of time, a pump pumps the liquid out of the washer basket and washer tub. The rinse operation is similar to the wash operation in that it includes filling the washer basket and the washer tub to a previously assigned level, agitating for a predetermined amount of time, and pumping the wash liquid out of the basket and tub. Typically, the wash cycle includes one wash operation and one rinse operation, but most washing machines provide an optional extra rinse operation to further remove any remaining detergent. Once a majority of the wash liquid has been removed by the rinse operation, the spin operation begins extracting additional liquid from the articles. During the spin operation, the washer basket rotates in one direction at a high angular velocity. This rotation creates a centrifugal force on the articles and the wash liquid causing excess liquid to exit or be extracted through perforations in the washer basket wall.

In order for the wash cycle to effectively clean the articles, it is necessary to ensure that the washing machine fills the washer basket and washer tub with an adequate amount of liquid such as water for agitation. If the amount of water provided is too low, then the articles might not have enough water to effectively clean the articles. In addition, too low of a water level will result in a large amount of mechanical stress on the agitator and its drive system (i.e., motor, transmission, and pulley, brake and clutch system). Furthermore, if there is a low level of water, then the articles cannot move as well which increases the possibility of damage to the articles. On the other hand, if there is too much water, then some of the articles will float in the washer basket and not receive enough interfacial wash action from the agitator to effectively clean the articles. Too much water is also energy inefficient because water is being wasted along with energy expended to heat, pump, and agitate the extra water. Another problem with adding too much water is that the agitator will not be able to impart the proper amount of back and forth motion to the articles for optimal cleaning or rinsing.

One approach used to overcome the above problems is to automatically control the amount of water added to the washer basket and washer tub during a wash cycle with an adaptive fill controller. In this approach the adaptive fill controller monitors the change in the phase angle of the motor while the washing machine is simultaneously filling with water and agitating. In order for the adaptive fill controller to work properly, the flow rate of water into the washing machine needs to be relatively constant. Generally, the flow rate of the water into the washing machine is not constant. Running a dishwasher or flushing a toilet while using the washing machine are some possible examples that may cause the flow rate of water to vary.

Typically, placing a flow restrictor in the housing of the water valves or inline with the water flow can provide a relatively constant flow rate. The flow restrictor is a pliable device that constricts an orifice as water pressure increases. The nominal flow rate when using a flow restrictor is about 6 gallons per minute even though the house water pressure might vary from 20 psi to 100 psi. One problem with the flow restrictor is that it degrades with time as the restrictor becomes less pliable. Other reasons for degradation include partial clogging of the orifice due to small particulates of sand or other foreign objects in the water supply. Another problem with the restrictor is that it is less effective as the water pressure drops below 20 psi which could occur in a house that uses well water with limited availability. Accordingly, there is a need to be able to compensate for varying flow rates without have to use a flow restrictor.

SUMMARY OF THE INVENTION

This invention is able to compensate for varying flow rates without having to use a flow restrictor by monitoring the phase angle of the motor and the flow rate of the inlet liquid while agitating, determining a derivative of the phase angle and normalizing the derivative of the phase angle to the instantaneous flow rate. The normalized derivative of the phase angle is used to determine an optimal level of liquid to be added to the washer basket and washer tub during a wash cycle operation.

In accordance with this invention there is disclosed a washing machine and method for cleansing articles. In this invention, the washing machine comprises a washer tub and a washer basket disposed in the washer tub for receiving the articles. A liquid supply source supplies a liquid to the washer tub and washer basket. An agitator disposed in the washer basket driven by a motor displaces the articles and the liquid. A flow rate monitor monitors the flow rate of the liquid supplied to the washer tub and the washer basket and provides a signal representation thereof. An agitator load monitor monitors the agitator load while displacing the articles and the liquid and provides a signal representation thereof. A controller, responsive to the flow rate monitor and the agitator load monitor, determines an optimal level of liquid to be supplied to the washer tub and the washer basket for a wash cycle operation of the washing machine as a function of the flow rate and the agitator load.

In accordance with a first embodiment of this invention there is disclosed another washing machine and method for cleansing articles. In this embodiment, the washing machine comprises a washer tub and a washer basket disposed in the washer tub for receiving the articles. A liquid supply source supplies a liquid to the washer tub and washer basket. An agitator disposed in the washer basket driven by a motor displaces the articles and the liquid. A liquid level sensor measures a level of liquid in the washer tub and washer basket and provides a signal representation thereof. A phase angle sensor measures the phase angle of the motor and provides a signal representation thereof. A controller, responsive to the liquid level sensor and the phase angle sensor, determines an optimal level of liquid to be supplied to the washer tub and the washer basket for a wash cycle operation of the washing machine as a function of the liquid level and the phase angle.

In accordance with a second embodiment of this invention there is disclosed still another washing machine and method for cleansing articles. In this embodiment, the washing machine comprises a washer tub and a washer basket disposed in the washer tub for receiving the articles. A liquid supply source supplies a liquid to the washer tub and washer basket. An agitator disposed in the washer basket driven by a motor displaces the articles and the liquid. A flow rate sensor measures a flow rate of the liquid supplied to the washer tub and the washer basket by the liquid supply source and provides a signal representation thereof. A phase angle sensor measures the phase angle of the motor and provides a signal representation thereof. A controller, responsive to the flow rate sensor and the phase angle sensor, determines an optimal level of liquid to be supplied to the washer tub and the washer basket for a wash cycle operation of the washing machine as a function of the flow rate and the phase angle.

DETAILED DESCRIPTION OF THE INVENTION

Figure 1:
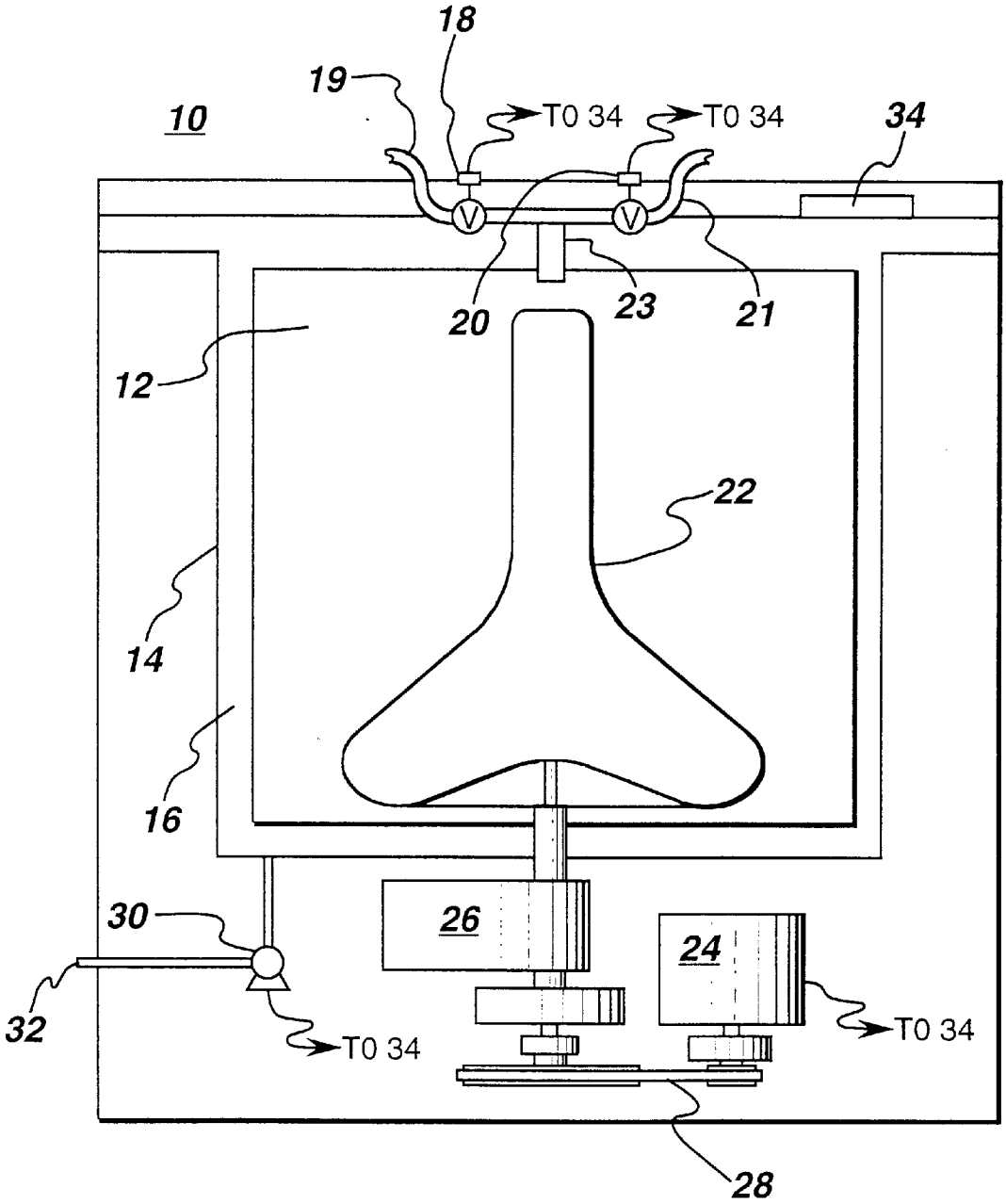
FIG. 1 shows a front elevational view of a portion of a washing machine according to this invention with its front panel removed.

FIG. 1 shows a front elevational view of a portion of a washing machine 10 according to this invention with its front panel removed. The washing machine 10 includes a washer basket 12 movably disposed in a washer tub 14 for receiving clothing and other articles to be cleansed. An annulus 16 separates the washer basket 12 from the washer tub 14. The washer basket 12 preferably has perforations throughout its wall to allow fluid communication between the interior of the basket and the washer tub 14. A hot liquid valve 18 and a cold liquid valve 20 provide water or other washing liquid to the washer basket 12 and the washer tub 14 through a hot liquid hose 19 and a cold liquid hose 21, respectively. The liquid valves and the liquid hoses comprise the washing machine's liquid supply source. A liquid inlet tube 23 connected to both the hot liquid hose 19 and the cold liquid hose 21 provide liquid to the washer basket 12 and the washer tub 14 through a spray fill conduit.

An agitator 22 disposed in the washer basket 12 imparts an oscillatory motion that displaces the articles and the liquid in the basket. FIG. 1 shows the washer basket 12 and the agitator 22 oriented to rotate about a vertical axis. The following describes the invention with reference to a vertical axis washing machine, however, the invention may use a horizontal axis washing machine or a washing machine having an axis at an angle between vertical and horizontal. A drive motor 24 such as an AC induction motor drives the washer basket 12 and the agitator 22 so that the basket rotates within the tub and the agitator moves in an oscillatory motion. A transmission 26 coupled to the motor 24 by a pulley, brake, and clutch system 28 transmit a back and forth motion imparted by the agitator. The motor 24, the transmission 26, and the pulley, brake and clutch system 28 comprise the washing machine's drive system. A pump 30 pumps liquid out of the washer basket 12, the washer tub 14 and annulus 16 through a drain hose 32.

A controller 34 controls the operation of the washing machine 10 which has a user interface that allows the user to select a wash cycle for washing a given type of articles and to start the machine. In response to the user selection, the controller 34 turns on the hot liquid valve 18 and/or the cold liquid valve 20 to fill the washer basket 12 and the washer tub 14 with liquid to a predetermined initial fill level. After the liquid reaches the predetermined initial level, the controller 34 directs the agitator 22 to begin agitating. An agitation cycle typically involves a forward stroke followed by a reverse stroke, with the agitator arc and velocity during each stroke being determined by the drive system and the operating characteristics of the motor. The articles disposed in the washer basket 12 together with the liquid in the basket create a reactive torque on the agitator 22 which provides an agitator load signature. The agitator load is reflective of the work being expended to displace the agitator 22, the articles and the liquid in the washer basket 12.

The agitator load also results in a corresponding reactive torque on the drive system. The reactive torque on the drive system varies such that the amount of reactive torque on the motor 24 is at least near the optimal liquid level (i.e., a liquid level sufficient to provide effective cleansing of the articles). At less than the optimal liquid level, the reactive torque on the agitator 22 and hence the drive system is greater than that seen at the optimal liquid level due to the work required of the agitator to mechanically displace the articles. Agitation at less than the optimal liquid level may harm the articles. At higher than the optimal liquid level, the reactive torque on the agitator 22 and motor 24 is also greater than the level of reactive torque experienced at the optimal liquid level due to the displacement of the extra mass of liquid beyond that required for adequate turnover. Thus, the reactive torque will have a minimum value at the optimal liquid level. A more detailed discussion of determining the optimal liquid level from the agitator load is set forth in U.S. Pat. No. 5,669,095, which is incorporated herein by reference.

Since the reactive torque typically has a minimum value at the optimal liquid level, one can deduce the optimal liquid level from the agitator load signature. Direct or indirect indications of agitator load can be used to generate the load signature from agitation cycles. When the value of such load measurements is at or near its minimum value, then the optimal fill level has been reached. To obtain a direct measurement of torque, one may use a torque sensor (e.g., a strain gage) coupled to the drive shaft of the agitator 22, while to obtain an indirect measurement, one may measure electrical parameters of the drive system. Examples of indirect measurements include measuring the phase angle of the AC induction drive motor or measuring parameters (e.g., current or voltage measurements) of torque command motors (also referred to generically as controlled speed motors) such as electronically commutated motors (ECM), switched reluctance motors (SRM), universal motors, or the like. For each type of electrical motor noted, the load on the motor can be determined by measuring selected electrical parameters of the motor, which can then be used to generate the agitator load signature.

In this invention, during the agitation, an agitator load monitors the load on the agitator while it displaces the articles and the liquid and provides a signal representative of the agitator load to the controller 34. Also, a flow monitor monitors the flow rate of liquid supplied to the washer basket 12 and the washer tub 14 and provides a signal representative of the flow rate to the controller 34. A more detailed discussion of the flow monitor and the agitator load monitor follows below. The controller 34 determines an optimal level of liquid to be supplied to the washer basket 12 and the washer tub 14 as a function of the flow rate and the agitator load. The controller 34 directs the liquid supply source to fill the washer basket 12 and the washer tub 14 with the optimal level of liquid.

Figure 2:
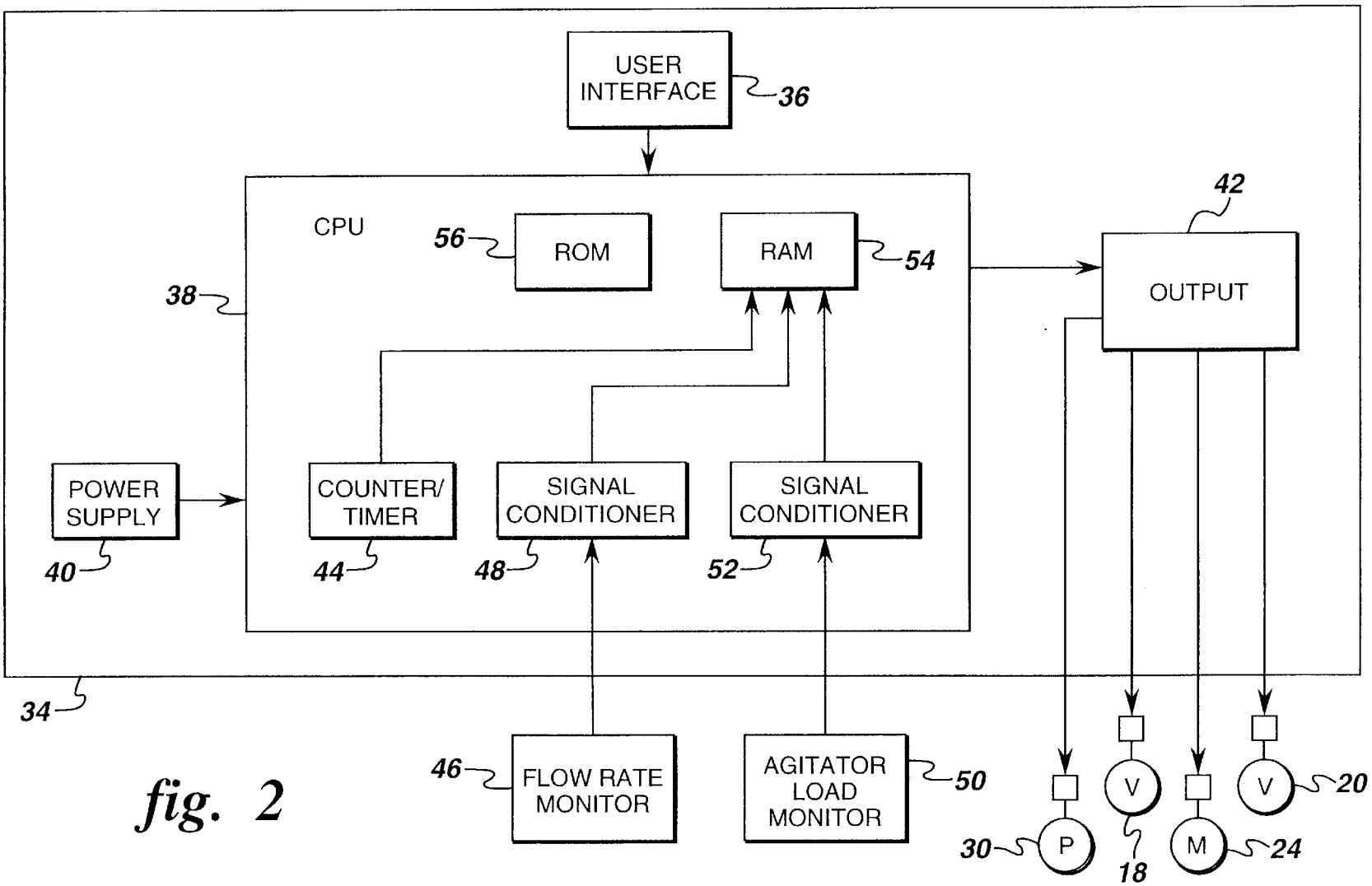
FIG. 2 shows a more detailed view of the controller according to the invention shown in FIG. 1.

FIG. 2 shows a more detailed view of the controller 34 according to the invention shown in FIG. 1. The controller 34 comprises a user interface 36 that allows the user to select a wash cycle for washing a particular type of articles and to start the washing machine 10. A central processing unit (CPU) 38 which receives power from a power supply 40 initializes the washing machine 10 and sends signals to output circuit 42. The output circuit 42 instructs the hot liquid valve 18 and/or the cold liquid valve 20 to fill the washer basket 12 and washer tub 14 with liquid up to the predetermined initial level. After the predetermined initial level has been reached, the CPU 38 sends a signal to the output circuit 42 which instructs the motor 24 and the rest of the drive system to begin driving the agitator 22.

During the agitation, a flow rate monitor 46 monitors the flow rate of the liquid supplied to the washer tub 14 and the washer basket 12. The flow rate monitor 46 outputs a signal representative of the flow rate of the liquid supplied to a signal conditioner 48. In addition, an agitator load monitor 50 monitors the load on the agitator 22 while agitating and outputs a signal representative of the agitator load to a signal conditioner 52. The values from the signal conditioners 48 and 52 are stored in a random access memory (RAM) 54. The CPU 38 accesses the values stored in the RAM 54 and uses a flow rate compensation algorithm and an adaptive fill algorithm stored in a read only memory (ROM) 56 to determine an optimal level of liquid to be supplied for a wash cycle operation. After the optimal level of liquid has been reached, then the CPU 38 sends signals to the output circuit 42 instructing the hot liquid valve 18 and/or the cold liquid valve 20 to turn off.

Figure 3:
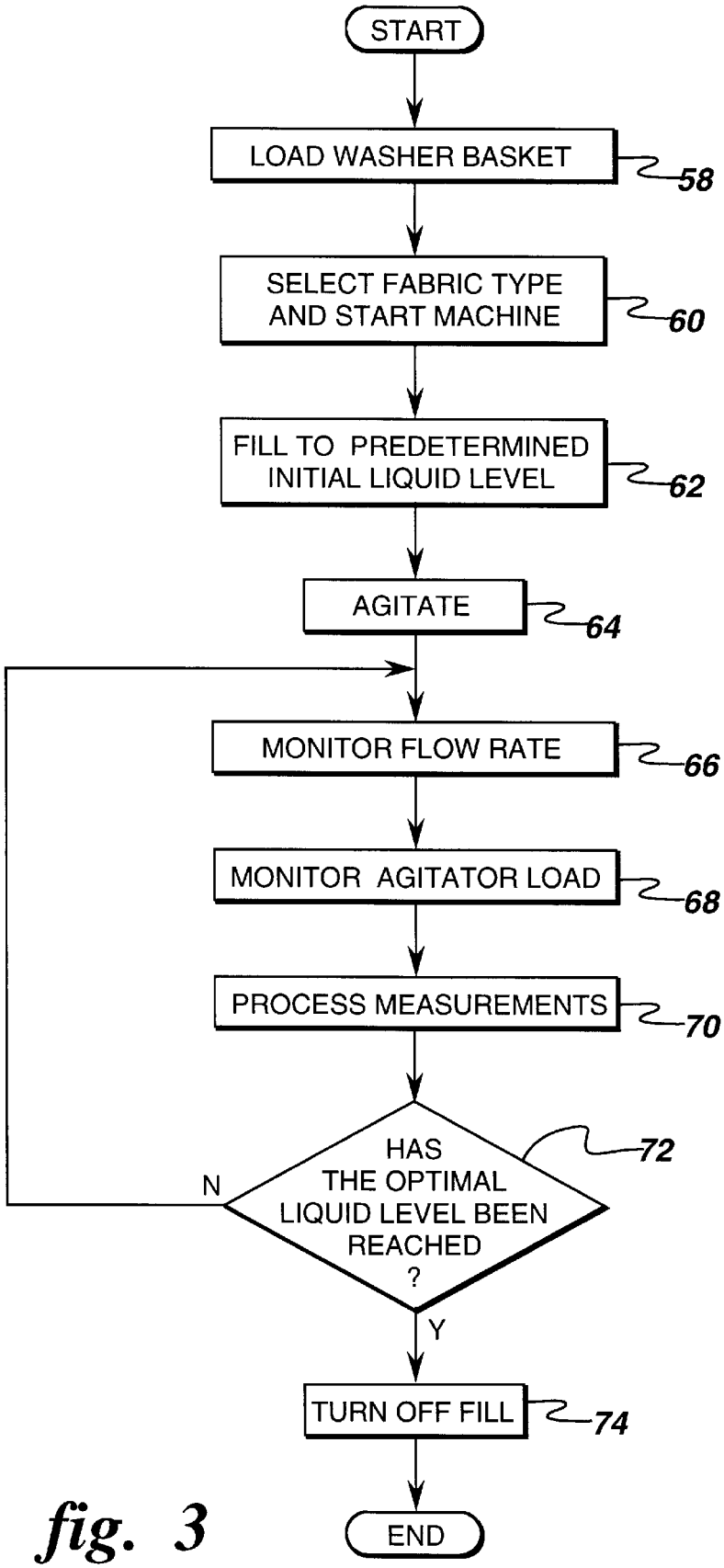
FIG. 3 shows a flow chart setting forth the steps performed in the invention shown in FIGS. 1 and 2.

As mentioned above, the flow rate compensation algorithm and the adaptive fill algorithm stored in the ROM 56 determine the optimal level of liquid to be supplied in a wash cycle operation. FIG. 3 shows a flow chart setting forth the steps performed in this invention to determine the optimal liquid level. At 58 the user loads the washer basket 12 with articles to be washed. The user then selects a fabric type for the articles that are to be washed and starts the washing machine at 60. In response to the user selection, the controller 34 turns on the hot liquid valve 18 and/or the cold water valve 20 and fills the washer basket 12 and the washer tub 14 with a predetermined initial level of liquid at 62. After the liquid reaches the predetermined initial level, the controller 34 instructs the motor 24 and the rest of the drive system to begin driving the agitator 22 at 64.

During agitation, the flow rate monitor 46 monitors the flow rate of the liquid supplied to the washer tub 14 and the washer basket 12 and the agitator load monitor 50 monitors the load on the agitator 22 while agitating at 66 and 68, respectively. In particular, during agitation, the signal conditioner 52 determines a derivative of the agitator load and normalizes the derivative of the agitator load to the flow rate. The optimal level of liquid is determined from the normalized derivative of the agitator load. Determining the derivative of the agitator load, normalizing the derivative to the flow rate and determining the liquid level is shown at block 70. Below is a more detailed discussion of the flow rate monitor, the agitator load monitor and the determination of the optimal level.

The controller 34 instructs the hot liquid valve 18 and/or the cold liquid valve 20 to continue filling the washer basket 12 and washer tub 14 with liquid until it has been determined at 72 that the optimal liquid level has been reached. After filling to the determined liquid level the fill is turned off at 74 and the washing machine is ready to begin the wash operation. Once the wash operation is completed then the rinse and spin operations are undertaken. Optimal fill levels for the rinse operations can be generated in the same fashion; alternatively, the rinse level can be the same as the fill level in the wash operation- or some predetermined portion of the wash operation fill level.

Figure 4:
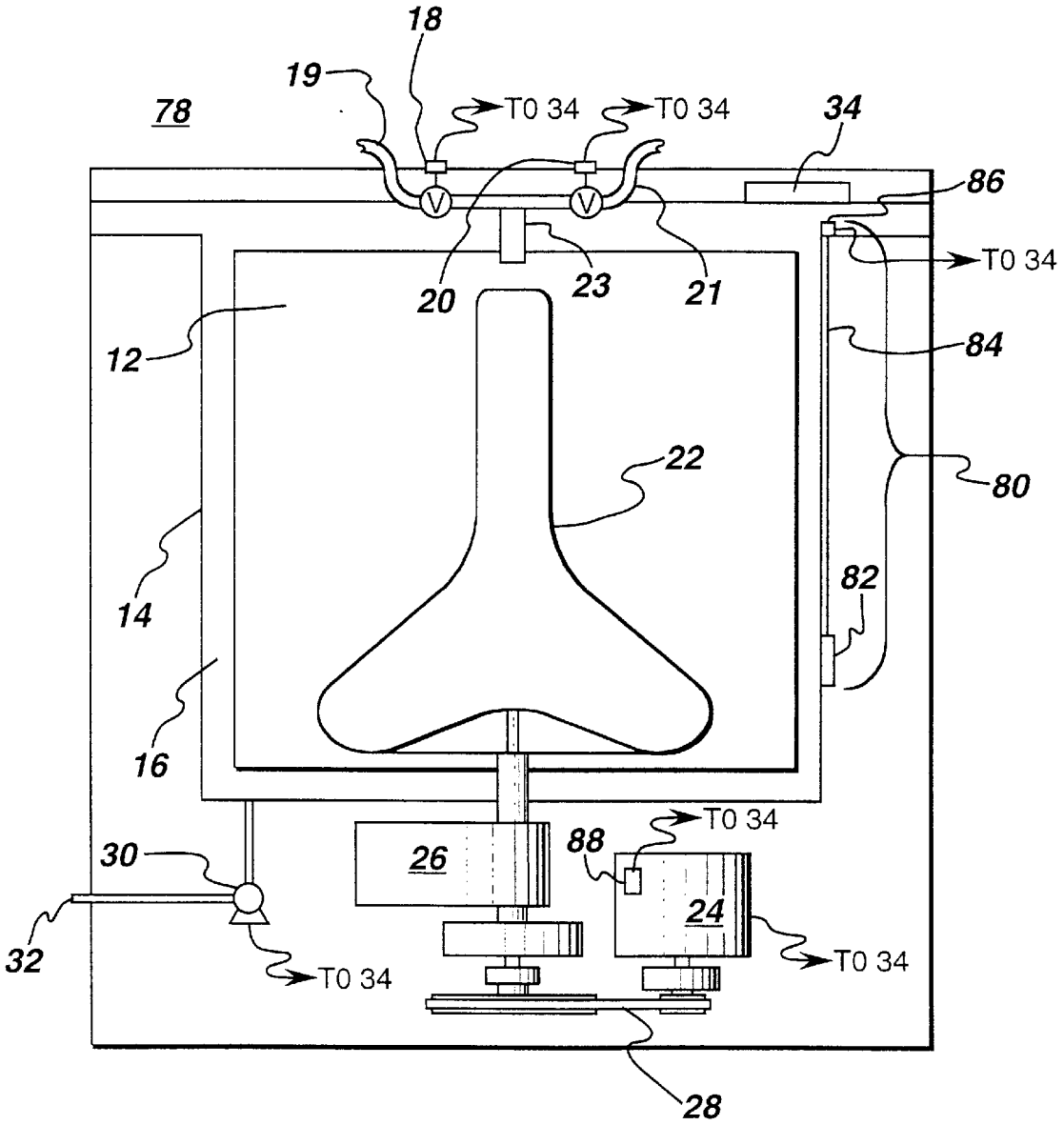
FIG. 4 shows a first embodiment of the washing machine shown in FIG. 1.

FIG. 4 shows a first embodiment of the washing machine shown in FIG. 1. FIG. 4 shows a front elevational view of a portion of a washing machine 78 according to this invention with its front panel removed. In addition to the elements described for FIG. 1, the washing machine 78 comprises a liquid level sensor 80 that measures the liquid level in the washer tub 14. The liquid level sensor 80 provides a signal representative of the liquid level to the controller 34. In this embodiment, the liquid level sensor 80 includes a reservoir 82 integrally formed in the washer tub 14. Once the liquid in the washer tub 14 reaches above the opening of the reservoir 82 air becomes trapped in the reservoir and cannot escape. The trapped air creates a pressure differential in a capillary tube 84 that is attached to the reservoir 82. The pressure differential in the capillary tube 84 corresponds to the height of the liquid in the annulus 16 above the opening of the reservoir 82. A pressure sensor 86 measures the pressure differential in the capillary tube and sends a signal thereof to the controller 34. The washing machine 78 also comprises a phase angle sensor 88 coupled to the motor 24 for measuring the phase angle. A more detailed description of the phase angle sensor and how it obtains agitator load information is provided in U.S. Pat. No. 5,669,095.

Figure 5:
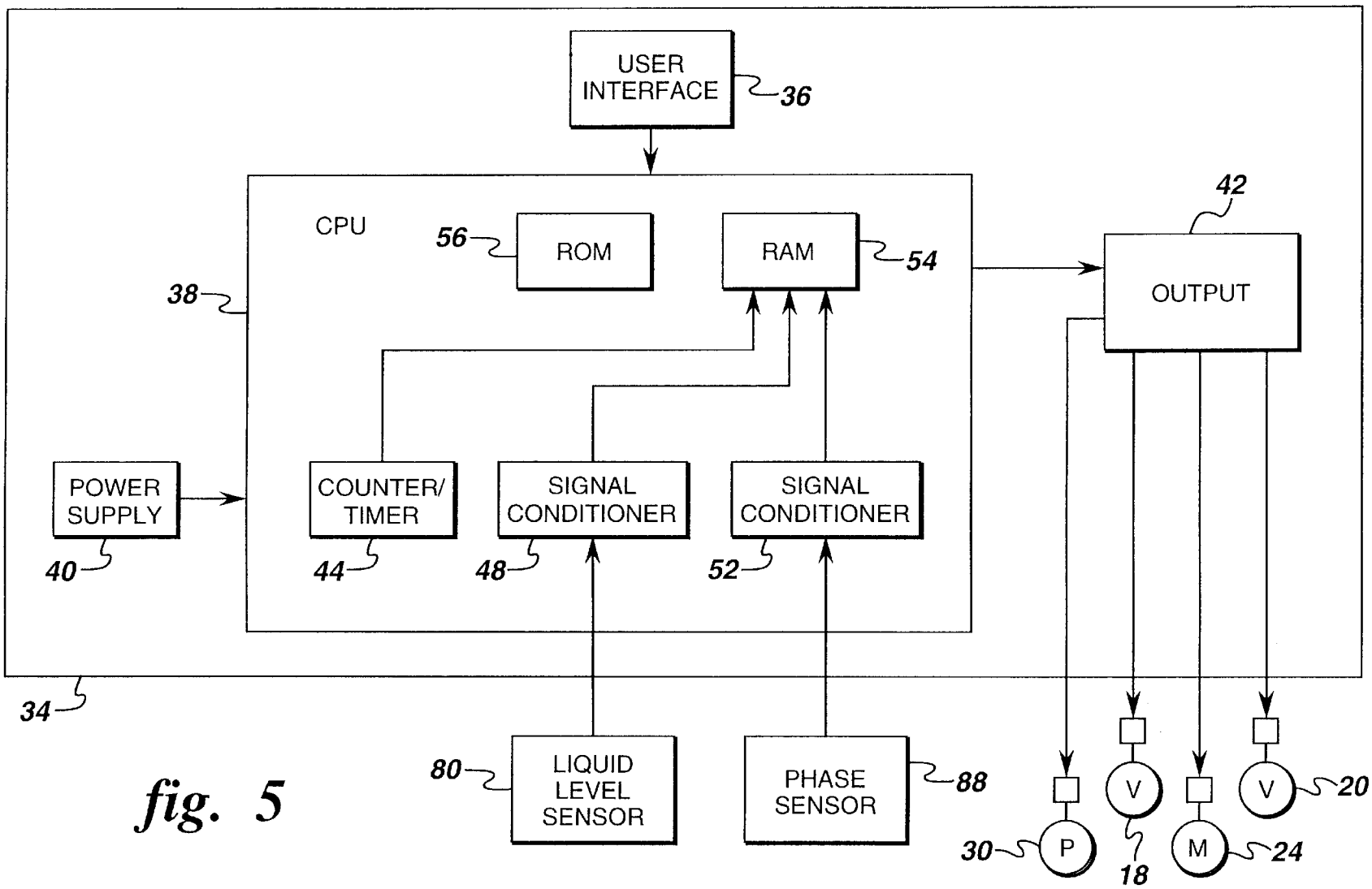
FIG. 5 shows a more detailed view of the controller shown in FIG. 4.
Figure 6:
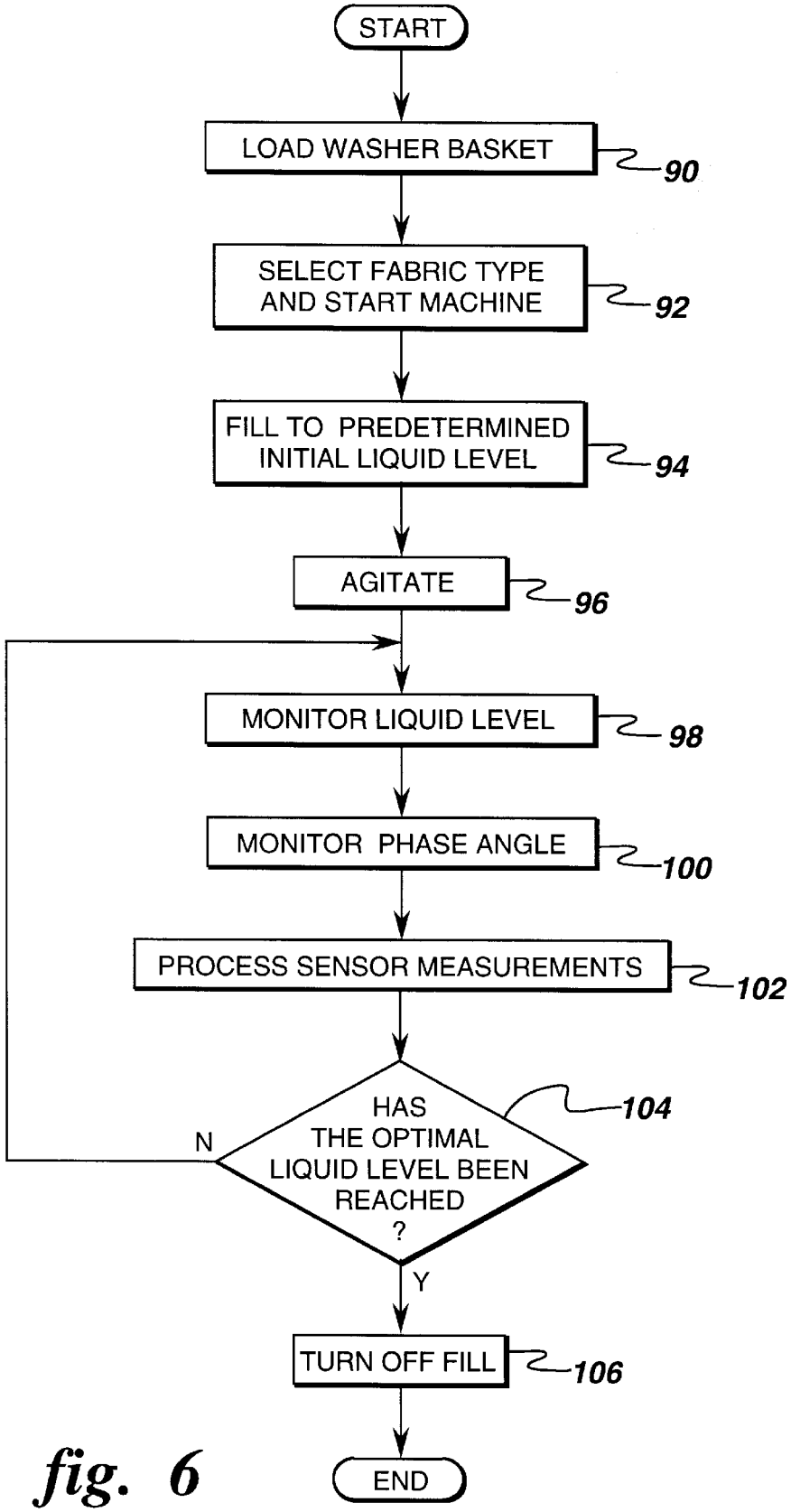
FIG. 6 shows a flow chart setting forth the steps performed in the embodiment shown in FIGS. 4 and 5.

FIG. 5 shows a more detailed view of the controller shown in FIG. 4. In addition to the elements shown in FIG. 2, FIG. 5 shows the liquid level sensor 80 and the phase angle sensor 88 coupled to the signal conditioners 48 and 52, respectively. FIG. 6 shows a flow chart setting forth the steps performed in the embodiment shown in FIGS. 4 and 5. The controller 34 determines the optimal liquid level as a function of the liquid level measurement and the phase angle measurement. In order to determine the optimal liquid level, the controller 34 determines the derivative of the phase angle. Also, the controller 34 determines the derivative of the liquid level measurement which is analogous to the instantaneous flow rate. Next, the controller 34 normalizes the derivative of the phase angle to the derivative of the liquid level measurement. In order to normalize the derivative of the phase angle to the derivative of the liquid level measurement, the controller 34 uses the following equation:

$$dP/dt_{compensated}=dP/dt^{*}\ (6/\text{flow_rate}+0.75)$$

wherein dP/dt is the derivative of the phase angle;

$dP/dt_{compensated}$ is the derivative of the phase angle after compensation for flow rate;

6 is the nominal flow rate; and 0.75 is the correction factor determined experimentally.

The controller then uses the normalized derivative of the phase angle to determine the optimal liquid level in the manner described in U.S. Pat. No. 5,669,095. in particular, the counter 44 counts the number of near zero derivative values so as to minimize the chance of an anomalous measurement resulting in premature cessation of filling of the washing machine. After a predetermined number of near zero values have been counted (e.g., 3 values that are near zero), the controller 34 generates the control signal representative of the optimal level to the liquid supply source.

Figure 7:
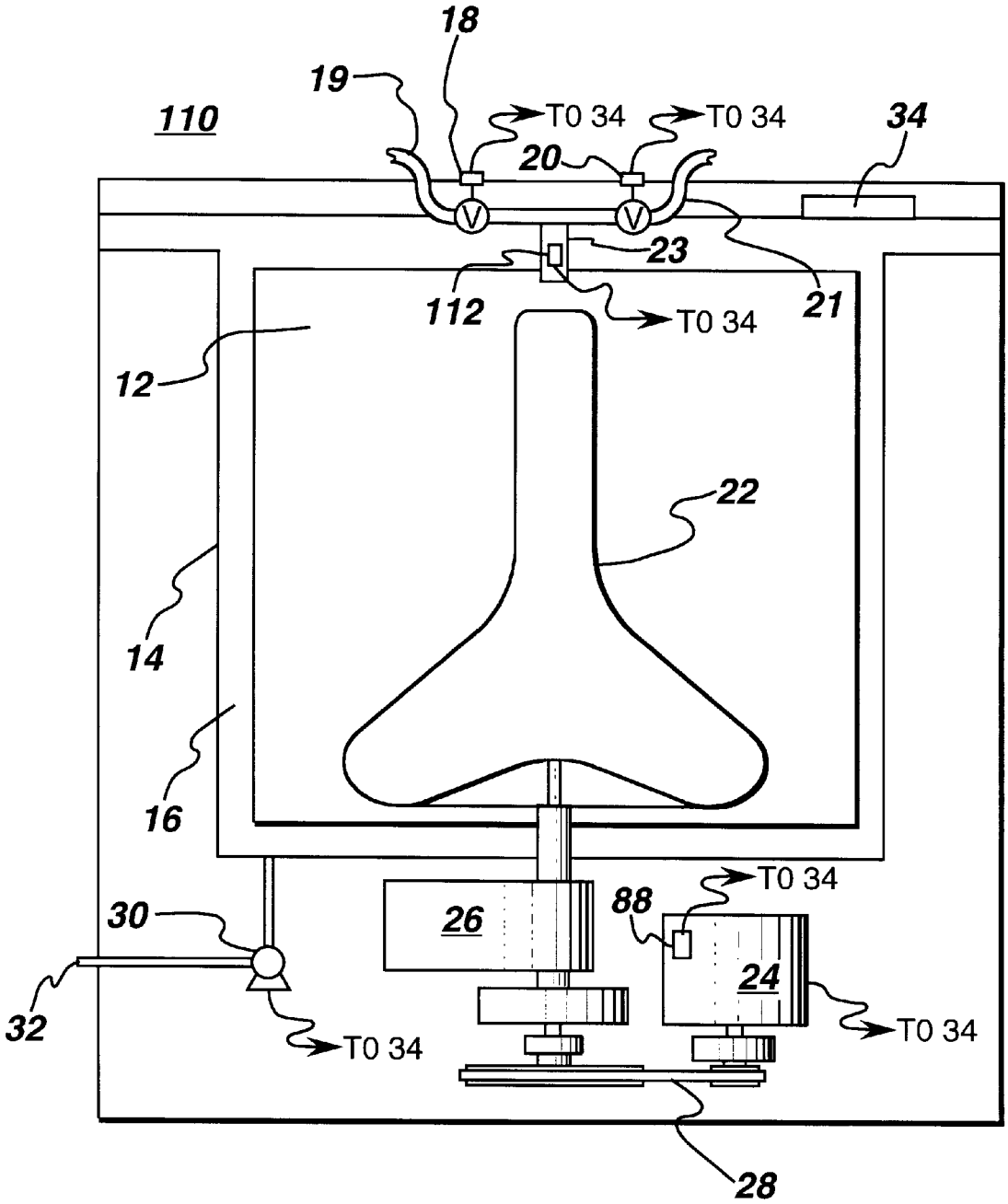
FIG. 7 shows a second embodiment of the washing machine shown in FIG. 1.

FIG. 7 shows another embodiment of the washing machine shown in FIG. 1. FIG. 7 shows a front elevational view of a portion of a washing machine 110 according to this invention with its front panel removed. In addition to the elements described for FIG. 1, the washing machine 110 comprises a flow rate sensor 112 located at the connection between the hot liquid valve 18 and the cold liquid valve 20. The flow rate sensor measures the flow rate of liquid supplied to the washer basket 12 and the washer tub 14 and provides a signal representative of the flow rate to the controller 34. The flow rate sensor is preferably a paddle wheel, however, other types of flow rate sensors such as ultrasonic or other acoustic-based flow sensors can be used. Furthermore, one of ordinary skill in the art will recognize that more than one flow rate sensor can be used. In particular, a flow rate sensor can be placed on both the hot liquid valve 18 and the cold liquid valve 20.

Figure 8:
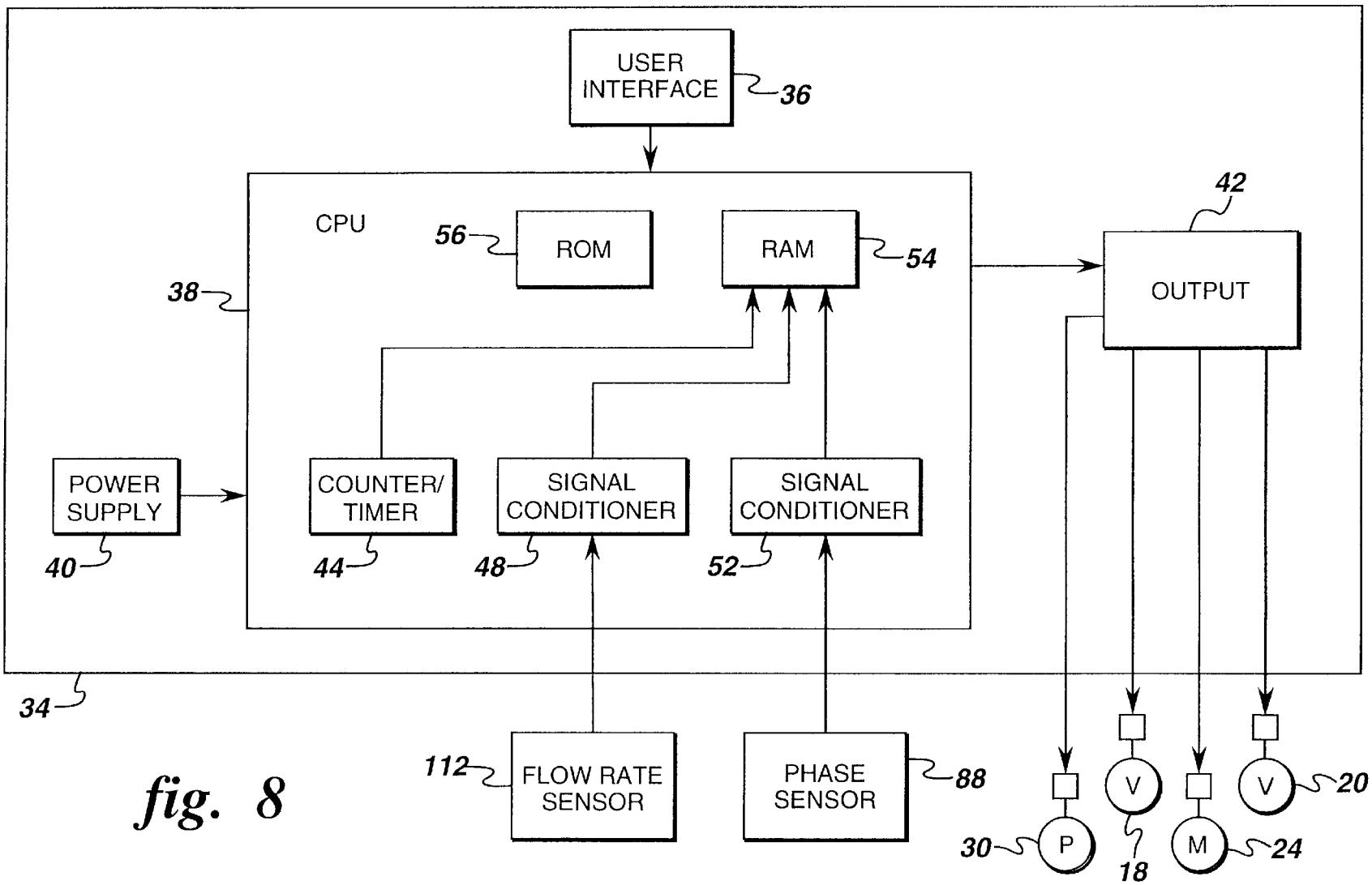
FIG. 8 shows a more detailed view of the controller shown in FIG. 7.
Figure 9:
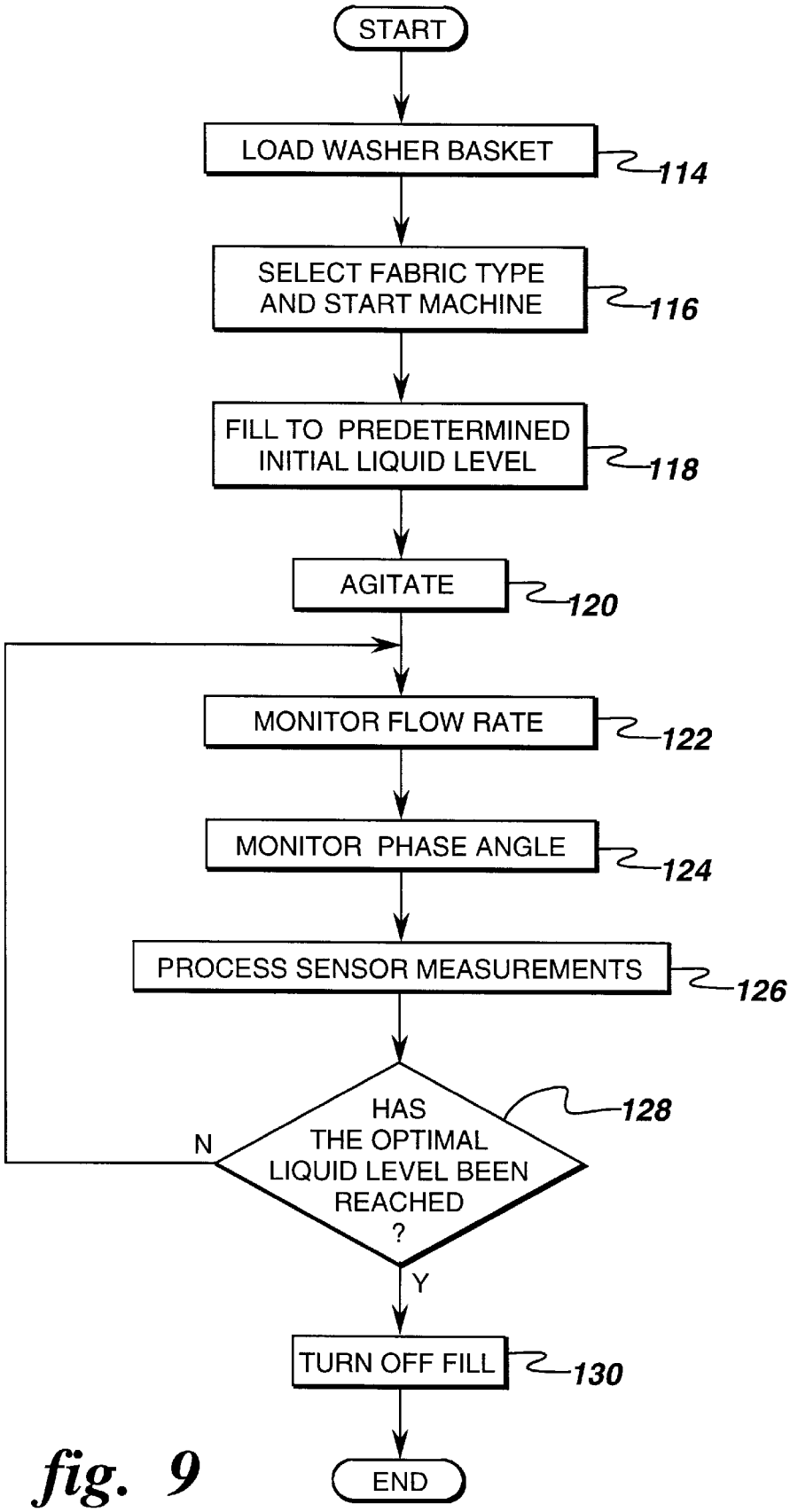
FIG. 9 shows a flow chart setting forth the steps performed in the embodiment shown in FIGS. 7 and 8.

The washing machine 110 also comprises a phase angle sensor 88 coupled to the motor 24 for measuring the phase angle. The phase angle sensor 88 is similar to the one described in FIG. 4. FIG. 8 shows a more detailed view of the controller shown in FIG. 7. In addition to the elements shown in FIG. 2, FIG. 8 shows the flow rate sensor 112 and the phase angle sensor 88 coupled to the signal conditioners 48 and 52, respectively. FIG. 9 shows a flow chart setting forth the steps performed in the embodiment shown in FIGS. 7 and 8. In this embodiment, the controller 34 monitors the flow rate and the phase angle. The controller 34 determines the optimal liquid level as a function of the flow rate and the phase angle. In order to determine the optimal liquid level, the controller 34 determines the derivative of the phase angle. Next, the controller 34 normalizes the derivative of the phase angle to the flow rate measurement in accordance with equation 1. The controller then uses the normalized derivative of the phase angle to determine the optimal liquid level in the aforementioned manner.

It is therefore apparent that there has been provided in accordance with the present invention, a system and method for providing flow rate compensation in a washing machine that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

What is claimed is:

1. A washing machine for cleansing articles, comprising:

a washer tub;

a washer basket disposed in said washer tub for receiving the articles;

a liquid supply source for supplying a liquid to said washer tub and said washer basket;

an agitator disposed in said washer basket for displacing the articles and the liquid;

a flow rate monitor for monitoring the flow rate of the liquid supplied to said washer tub and said washer basket and providing a signal representation thereof;

an agitator load monitor for monitoring the agitator load while displacing the articles and the liquid and providing a signal representation thereof; and a controller, responsive to said flow rate monitor and said agitator load monitor, for determining an optimal level of liquid to be supplied to said washer tub and said washer basket for a wash cycle operation of said washing machine as a function of the flow rate and the agitator load.

2. The washing machine according to claim 1, wherein said controller includes means for determining a derivative of the agitator load.

3. The washing machine according to claim 2, wherein said controller further includes means for normalizing the derivative of the agitator load to the flow rate.

4. The washing machine according to claim 3 wherein said controller further includes means for using the normalized derivative of the agitator load to determine the optimal water level.

5. The washing machine according to claim 1, wherein said agitator load monitor comprises a phase angle sensor for measuring the phase angle of a motor that drives said agitator.

6. The washing machine according to claim 1, wherein said agitator load monitor comprises a torque sensor for measuring the reactive torque of a motor that drives said agitator.

7. The washing machine according to claim 1, wherein said flow rate monitor comprises a liquid level sensor for measuring a level of liquid in said washer tub and said washer basket.

8. The washing machine according to claim 7, wherein said agitator load monitor comprises a phase angle sensor for measuring the phase angle of a motor that drives said agitator.

9. The washing machine according to claim 8, wherein said controller determines the optimal level of liquid as a function of the liquid level and the phase angle.

10. The washing machine according to claim 9, wherein said controller includes means for determining a derivative of the phase angle measurement and means for determining a derivative of the liquid level measurement.

11. The washing machine according to claim 10, wherein said controller further includes means for normalizing the derivative of the phase angle measurement to the derivative of the liquid level measurement.

12. The washing machine according to claim 11, wherein said controller further includes means for using the normalized derivative of the phase angle to determine the optimal water level.

13. The washing machine according to claim 1, wherein said flow rate monitor comprises a flow rate sensor for measuring a flow rate of the liquid supplied to said washer tub and said washer basket.

14. The washing machine according to claim 13, wherein said agitator load monitor comprises a phase angle sensor for measuring the phase angle of a motor that drives said agitator.

15. The washing machine according to claim 14, wherein said controller determines the optimal level of liquid as a function of the flow rate and the phase angle.

16. The washing machine according to claim 15, wherein said controller includes means for determining a derivative of the phase angle measurement.

17. The washing machine according to claim 16, wherein said controller further includes means for normalizing the derivative of the phase angle measurement to the flow rate measurement.

18. The washing machine according to claim 17, wherein said controller further includes means for using the normalized derivative of the phase angle to determine the optimal water level.

19. The washing machine according to claim 1, wherein the wash cycle operation comprises at least one wash operation and at least one rinse operation.

20. A washing machine for cleansing articles, comprising:

a washer tub;

a washer basket disposed in said washer tub for receiving the articles;

a liquid supply source for supplying a liquid to said washer tub and said washer basket;

an agitator disposed in said washer basket for displacing the articles and the liquid;

a motor for driving said agitator;

a liquid level sensor, for measuring a level of liquid in said washer tub and said washer basket and providing a signal representation thereof;

a phase angle sensor for measuring the phase angle of said motor and providing a signal representation thereof; and a controller, responsive to said liquid level sensor and said phase angle sensor, for determining an optimal level of liquid to be supplied to said washer tub and said washer basket for a wash cycle operation of said washing machine as a function of the liquid level and the phase angle.

21. The washing machine according to claim 20, wherein said controller includes means for determining a derivative of the phase angle measurement and means for determining a derivative of the liquid level measurement.

22. The washing machine according to claim 21, wherein said controller further includes means for normalizing the derivative of the phase angle measurement to the derivative of the liquid level measurement.

23. The washing machine according to claim 22, wherein said controller further includes means for using the normalized derivative of the phase angle to determine the optimal water level.

24. The washing machine according to claim 20, wherein the wash cycle operation comprises at least one wash operation and at least one rinse operation.

25. A washing machine for cleansing articles, comprising:

a washer tub;

a washer basket disposed in said washer tub for receiving the articles;

a liquid supply source for supplying a liquid to said washer tub and said washer basket;

an agitator disposed in said washer basket for displacing the articles and the liquid;

a motor for driving said agitator;

a flow rate sensor, for measuring a flow rate of the liquid supplied to said washer tub and said washer basket by said liquid supply source and providing a signal representation thereof;

a phase angle sensor for measuring the phase angle of said motor and providing a signal representation thereof; and a controller, responsive to said flow rate sensor and said phase angle sensor, for determining an optimal level of liquid to be supplied to said washer tub and said washer basket for a wash cycle operation of said washing machine as a function of the flow rate and the phase angle.

26. The washing machine according to claim 25, wherein said controller includes means for determining a derivative of the phase angle measurement.

27. The washing machine according to claim 26, wherein said controller further includes means for normalizing the derivative of the phase angle measurement to the flow rate measurement.

28. The washing machine according to claim 27, wherein said controller further includes means for using the normalized derivative of the phase angle to determine the optimal water level.

29. The washing machine according to claim 25, wherein the wash cycle operation comprises at least one wash operation and at least one rinse operation.

30. A method for determining an optimal level of liquid to be supplied in a wash cycle operation of a washing machine having a washer tub, a washer basket disposed in the washer tub for receiving articles therein, a liquid supply source for supplying a liquid to the washer tub and the washer basket and an agitator disposed in the washer basket driven by a motor for displacing the articles and the liquid, said method comprising:

supplying the liquid to the washer tub and the washer basket;

agitating the liquid and the articles in the washer basket;

monitoring the flow rate of the liquid supplied to the washer tub and the washer basket and providing a signal representation thereof;

monitoring the agitator load while displacing the articles and the liquid and providing a signal representation thereof; and determining the optimal level of liquid to be supplied in the wash cycle operation as a function of the flow rate and the agitator load.

31. The method according to claim 30, wherein said determining the optimal level of liquid comprises determining a derivative of the agitator load.

32. The method according to claim 31, further comprising normalizing the derivative of the agitator load to the flow rate.

33. The method according to claim 32, further comprising using the normalized derivative of the agitator load to determine the optimal water level.

34. The method according to claim 30, wherein said monitoring agitator load comprises measuring the phase angle of the motor.

35. The method according to claim 30, wherein said monitoring agitator load comprises measuring the reactive torque of the motor.

36. The method according to claim 30, wherein said monitoring flow rate comprises measuring a level of liquid in the washer tub and the washer basket.

37. The method according to claim 36, wherein said monitoring agitator load comprises measuring the phase angle of the motor.

38. The method according to claim 37, wherein said determining the optimal level of liquid is determined as a function of the liquid level and the phase angle.

39. The method according to claim 38, wherein said determining the optimal level of liquid comprises:

determining a derivative of the phase angle measurement; and determining a derivative of the liquid level measurement.

40. The method according to claim 39, further comprising normalizing the derivative of the phase angle measurement to the derivative of the liquid level measurement.

41. The method according to claim 40, further comprising using the normalized derivative of the phase angle to determine the optimal water level.

42. The method according to claim 30, wherein said monitoring flow rate comprises measuring a flow rate of the liquid supplied to the washer tub and the washer basket.

43. The method according to claim 42, wherein said monitoring agitator load comprises measuring the phase angle of the motor.

44. The method according to claim 43, wherein said determining the optimal level of liquid is determined as a function of the flow rate and the phase angle.

45. The method according to claim 44, wherein said determining the optimal level of liquid comprises determining a derivative of the phase angle.

46. The method according to claim 45, further comprising normalizing the derivative of the phase angle to the flow rate.

47. The method according to claim 46, further comprising using the normalized derivative of the phase angle to determine the optimal water level.

48. The method according to claim 30, wherein the wash cycle operation comprises at least one wash operation and at least one rinse operation.

49. A method for determining an optimal level of liquid to be supplied in a wash cycle operation of a washing machine having a washer tub, a washer basket disposed in the washer tub for receiving articles therein, a liquid supply source for supplying a liquid to the washer tub and the washer basket, an agitator disposed in the washer basket for displacing the articles and the liquid and a motor for driving the agitator, said method comprising:

supplying the liquid to the washer tub and the washer basket;

agitating the liquid and the articles in the washer basket;

measuring a level of liquid in the washer tub and the washer basket and providing a signal representation thereof;

measuring the phase angle of the motor and providing a signal representation thereof; and determining the optimal level of liquid to be supplied in the wash cycle operation as a function of the liquid level and the phase angle.

50. The method according to claim 49, wherein said determining the optimal level of liquid to be supplied in the wash cycle operation comprises:

determining a derivative of the phase angle measurement; and determining a derivative of the liquid level measurement.

51. The method according to claim 50, further comprising normalizing the derivative of the phase angle measurement to the derivative of the liquid level measurement.

52. The method according to claim 51, further comprising using the normalized derivative of the phase angle to determine the optimal water level.

53. The method according to claim 49, wherein the wash cycle operation comprises at least one wash operation and at least one rinse operation.

54. A method for determining an optimal level of liquid to be supplied in a wash cycle operation of a washing machine having a washer tub, a washer basket disposed in the washer tub for receiving articles therein, a liquid supply source for supplying a liquid to the washer tub and the washer basket, an agitator disposed in the washer basket for displacing the articles and the liquid and a motor for driving the agitator, said method comprising:

supplying the liquid to the washer tub and the washer basket;

agitating the liquid and the articles in the washer basket;

measuring a flow rate of the liquid supplied to the washer tub and the washer basket by the liquid supply source and providing a signal representation thereof measuring the phase angle of the motor and providing a signal representation thereof; and determining the optimal level of liquid to be supplied in the wash cycle operation as a function of the flow rate and the phase angle.

55. The method according to claim 54, wherein said determining the optimal level of liquid comprises determining a derivative of the phase angle measurement.

56. The method according to claim 55, further comprising normalizing the derivative of the phase angle measurement to the flow rate measurement.

57. The method according to claim 56, further comprising using the normalized derivative of the phase angle to determine the optimal water level.

58. The method according to claim 54, wherein the wash cycle operation comprises at least one wash operation and at least one rinse operation.

* * * * *